US005233814A

United States Patent [19]

Bergerioux et al.

[11] Patent Number: 5,233,814

[45] Date of Patent: Aug. 10, 1993

[54] BOX FILLING DEVICE, ESPECIALLY AT THE OUTPUT OF A POSTAL SORTING MACHINE

[75] Inventors: Jean-Marcel Bergerioux, Chateauneuf Sur Isere; Laurent Pellegrin, Livron Sur Drome, both of France

[73] Assignee: Compagnie Generale D'Automatisme CGA-HBS, Bretigny Sur Orge, France

[21] Appl. No.: 881,217

[22] Filed: May 11, 1992

[30] Foreign Application Priority Data

May 14, 1991 [FR] France ..... 91 05801

[51] Int. Cl.[5] ..... B65B 5/10; B65B 35/30; B65B 39/02; B65B 67/02

[52] U.S. Cl. ..... 53/536; 53/241; 53/260; 53/390; 53/542

[58] Field of Search ..... 53/241, 255, 260, 525, 53/540, 542, 536, 580, 390

[56] References Cited

U.S. PATENT DOCUMENTS

| | | | |
|---|---|---|---|
| 2,822,932 | 2/1958 | Patrick | 53/540 X |
| 3,854,270 | 12/1974 | Cloud et al. | 53/525 X |
| 3,942,303 | 3/1976 | Kristiansen | 53/542 |
| 4,048,784 | 9/1977 | Toby | 53/260 X |
| 4,518,160 | 5/1985 | Lambrechts et al. | 53/260 X |
| 4,570,419 | 2/1986 | Tinsley | 53/260 X |

FOREIGN PATENT DOCUMENTS

| | | | |
|---|---|---|---|
| 1214917 | 4/1966 | Fed. Rep. of Germany . | |
| 2288562 | 5/1976 | France . | |
| 2296585 | 7/1976 | France . | |
| 2552743 | 4/1985 | France . | |
| 0258504 | 10/1990 | Japan | 53/255 |

*Primary Examiner*—John Sipos
*Assistant Examiner*—Linda B. Johnson
*Attorney, Agent, or Firm*—Sughrue, Mion, Zinn, Macpeak & Seas

[57] ABSTRACT

A device for filling boxes, especially at the output of a machine sorting flat objects, particularly postal items, has at least one inclined support plate for diverted letters, a jogging member and a sliding plate subject to a restoring force. The device includes at least one bar retractable through at least one aperture in the box. Each bar is formed by two arms, of which a first arm is freely pivoted to the frame of the machine at its first end. A scrod arm extending the support plate in its operative position is freely pivoted on the second end of the first arm and rests with its first end of the bottom of the box.

11 Claims, 6 Drawing Sheets

BOX FILLING DEVICE, ESPECIALLY AT THE OUTPUT OF A POSTAL SORTING MACHINE

The present invention relates to a device for filling boxes, especially at the output of a machine sorting flat objects, particularly postal items or "letters", comprising at least one inclined support plate for diverted letters, a jogging member and a sliding plate subject to a restoring force, the device comprising at least one bar retractable through at least one cut-out formed in the box.

BACKGROUND OF THE INVENTION

Postal sorting machines comprise juxtaposed stacking modules adapted in number to the number of sorting destinations with which the machine has to cope.

These modules comprise compactors fed by a conveyor formed by two wheels between which letters are nipped. The conveyor is provided at each compactor with a switch, whose setting allows letters to be diverted towards the associated compactor, as necessary. In the region of each switch and at the bottom thereof there is located a support plate retaining the diverted letters and facilitating their stacking in conjunction with a jogging shoulder, against which the letters abut, thus defining one of the two side edges of the stack. At the front of the building stack, a sliding plate guided by a rod along which it can slide retracts in accordance with the growth of the stack. This sliding plate compresses the stack under the action of a restoring force provided by a spring or counterweight. Inclination of the support plate is necessary in order to obtain a proper stack.

In these sorting machines, the letters stacked on each support plate have to be removed by hand for placing in a corresponding box. This operation is costly because it needs much manual work repeatedly. Moreover it is tricky because the stack is hard to get hold of and can only be moved in sections.

French patent FR 2 552 743 describes a stacking machine whose stacking support bed comprises means cooperating with a matched receptacle in such a manner that, once filled with letters to be dispatched, the complete receptacle can be handled automatically. One embodiment has a sliding bar mechanism. Each of the bars is shaped like a crank and the upper part of the bar mechanism forms the support bed for the stack. By vertical translation and/or rotation, the bar mechanism can be retracted beneath the receptacle, which has suitable apertures. When the maximum size of the stack is detected, the operator holds back the end of the stack corresponding to the last letter stacked and actuates the retracting device for the bar mechanism.

This kind of device requires mechanical and/or electrical retracting members for the support bed, such as an actuator. This mechanism has to be actuated for retracting and accordingly filling of the receptacle and has to be returned to action after positioning an empty receptacle. Moreover it is only when the bar mechanism has been retracted that removal of the full receptacle can be commenced and only when the empty receptacle has been put in position that the bar mechanism can be restored. Besides the installation of a specific mechanism, this device needs a relatively long manipulation time.

Moreover, installing such a device on an existing sorting machine is not easy; the necessary adaptation requires relatively complex changes.

Finally the receptacle needed for this device has a series of longitudinal apertures in its bottom, corresponding to the passage of the bar mechanism over practically the whole length of the box. This receptacle cannot easily be used for another purpose and even in its specific use, letters can fall through the apertures.

The device in accordance with the invention enables these problems to be overcome.

SUMMARY OF THE INVENTION

To achieve this, each bar is formed by two arms, of which a first arm is freely pivoted to the frame of the machine at its first end, and a second arm extending the support plate in its operative position is freely pivoted on the second end of the first arm and rests with its first end on the bottom plane of the box.

Through this design, each bar forms an extension of the support plate with its second arm and, by free rotation of the first arm relative to the frame, and by sliding the first end of the second arm on the bottom plane of the box, the bar can be retracted through cut-outs in the box or conversely can be pushed into the operative stacking position extending the support plate. The device can easily be adapted to existing sorting machines.

The box is preferably placed on a slide-way inclined slightly in the sense opposite to that of the inclination of the support plate and in particular the slide-way may be provided with rollers.

This design allows a suitable arrangement of cut-outs in the box. In the preferred embodiment, the box is provided with at least one aperture for the passage of each bar, having an aperture formed in its rear wall and continuing into the bottom in such a manner that the end of this aperture located in the bottom of the box forms an abutment for at least one of the first arms during displacement of the box.

Accordingly, positioning the empty box on its slide-way leads by pushing to raising each bar, which assumes the operative position extending the support plate, and removal of the full box involves the downwards retraction of each bar.

This allows the two operations to be effected at the same time and results in a saving of time.

According to another feature, the box also has an aperture for each bar in its front wall, for passage of the first end of the second arm.

This makes it possible to have the optimum extension length for the support plate.

Moreover the support plate preferably has an end part provided with apertures for insertion of the second end of the second arm, in order to provide a good joint between the support plate and the second arm of each bar.

In order to obtain optimum kinematics, the device has the following features individually or in combination:

The second arm is pivoted near its second end on the first arm.

The first end of the second arm carries a roller.

The bars are at least three in number.

The first arm of each of the lateral bars of the bar mechanism carries a roller at a first elbow portion, as seen from the side, near to its first end, the roller rolling on the bottom of the box.

The first arm of each of the lateral bars of the bar mechanism comprises a second elbow portion, as seen from the side, in the shape of a U located at the rear of the device.

The central bars of the bar mechanism are each formed by a first arm fixed to the first arms of the lateral bars and by a second arm.

Because of the elbow portions of the first arms, the total length of each bar in retracted position is minimal and takes up minimal space.

BRIEF DESCRIPTION OF THE DRAWINGS

Embodiments of the invention are described by way of example with reference to the accompanying drawings, in which.

DETAILED DESCRIPTION

Figure 1:
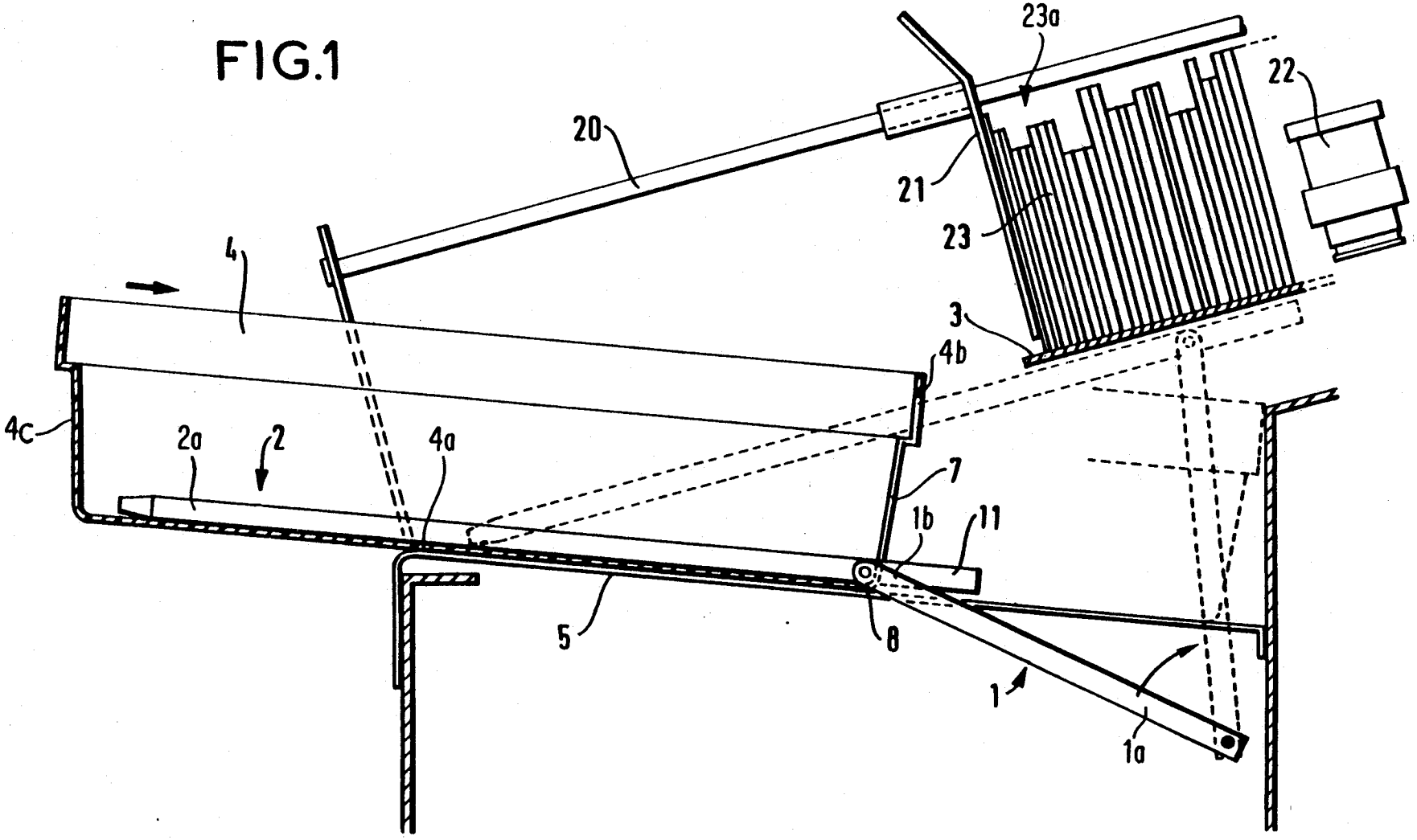
FIG. 1 is a longitudinal section of a first embodiment in retracted position.
Figure 2:
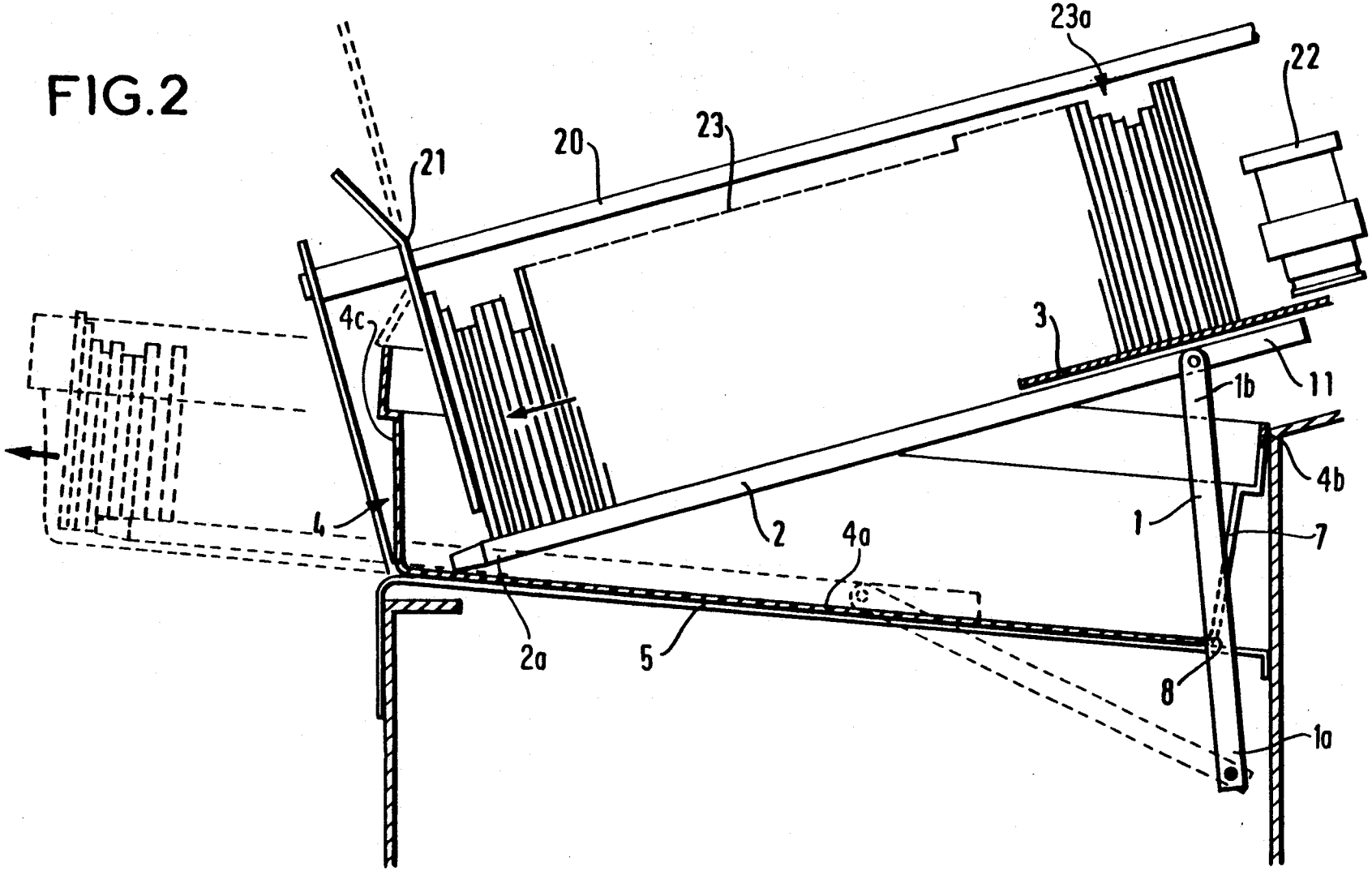
FIG. 2 is a similar view in operative position.

FIGS. 1 and 2 show a first variant embodiment of the invention.

The postal sorting machine comprises juxtaposed stacking modules. The output unit of one of these modules is shown here. This output unit comprise a compactor having a guide bar 20 parallel to and at the side of the output unit and providing for sliding of a sliding plate 21 on bar 20. The compactor is fitted upstream with a jogging roller 22, near the end of the support plate 3.

The diverted letters 23 stack under compression by the sliding plate 21, are under the action of a restoring force provided by a spring or a counterweight, not shown.

The device embodying the invention comprises a bar mechanism formed by two arms 1 and 2.

The mechanism preferably has five bars. FIGS. 1 and 2 show one lateral bar.

The first arm 1 is freely pivoted at its first end 1*a* on the frame of the machine. The second arm 2 extends the support plate 3 in its operative position. The second arm is freely pivoted on the second end 1*b* of the first arm 1 and rests with its first end 2*a* on the bottom 4*a* of the box 4.

This box 4 is located on a slide-way 5, inclined slightly in an opposite sense to that of the inclination of the support plate 3.

The box 4 is provided with apertures for passage of the bars. The corresponding apertures are each formed by an aperture 7 formed in the rear wall 4*a* of the box 4 and which extends into the bottom of the box 4 so that the end 8 of the aperture 7 located in the bottom of the box 4 forms an abutment for the first arm 1 when displacing the box 4.

As can be seen from the figures, the second arm 2 is pivoted near to its second end 11 on the first arm 1.

Moreover, the boxes 4 are preferably provided with apertures identical to the apertures 7 in their front faces, in order to be able to use them without regard to fore or aft orientation on slide-way 5.

The operation of the device is as follows:

FIG. 1: the bars are in retracted, full line position and the box 4 is put in place by introducing the arms 2 into the apertures 7.

The end 8 of the aperture 7 comes into abutment with the second end 1*b* of arm 1 and as the box 4 continues to be put into place on its slide-way 5, the arm 1 is raised so as to assume the operative, projected position (shown in broken lines), where the arm 2 is disposed as an extension of the support plate 3.

FIG. 2 the stacking of the letters 23 takes place on the support plate 3 and on the arm 2 in its operative position, up to the maximum capacity.

At this moment, the operator withdraws the sliding plate 21 by swinging it up and about the axis guide bar 20, the front face of the stack then coming into abutment with the front wall 4*a* of the box 4, and the operator returns the sliding plate 21 in front of the compactor to support the newly forming stack 23*a*.

The operator then pushes the stack 23*a* which comes into place in the box 4, which pushes out of its slide-way and which thus causes displacement of the arms 1 and 2 into their retracted position, FIG. 2, (broken lines) where the full box 4 can be removed for further processing.

An empty box then be put in place and the operating cycle starts again.

It should be noted that the operations of removing the full box and putting the empty box in place do not require the sorting machine to be stopped. The diverted letters 23 stack on the support plate 3 during these operations, which can be effected very quickly.

Figure 3:
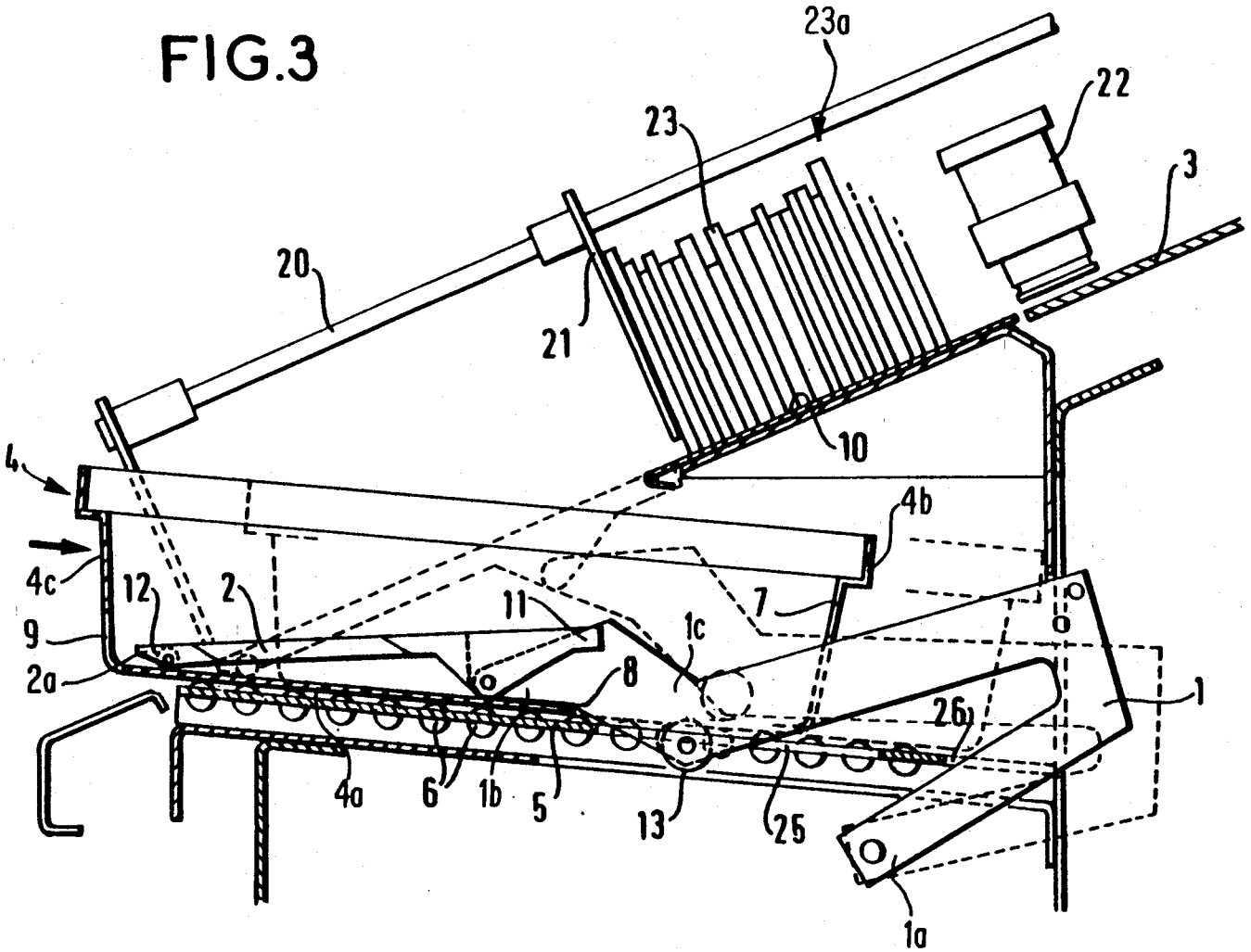
FIG. 3 is a longitudinal section of a second embodiment, in retracted position.
Figure 4:
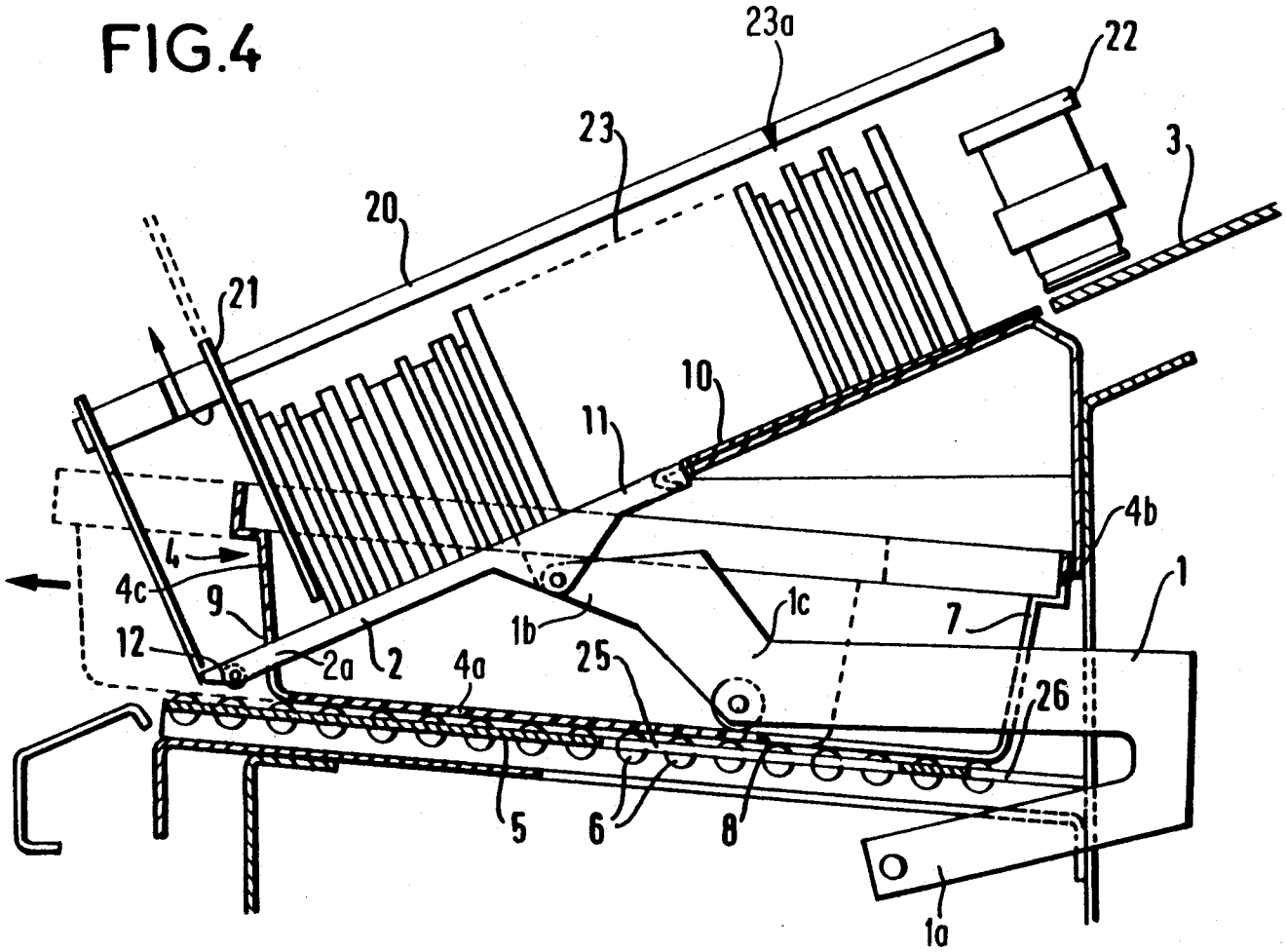
FIG. 4 is similar longitudinal section to that of FIG. 3 in an extended position.

FIGS. 3 and 4 are views similar to FIGS. 1 and 2 showing a preferred variant embodiment of the invention where like elements have like numeral designations.

The foregoing description applies to these figures and only the additional features are dealt with below.

FIGS. 3 and 4 show a lateral bar; the form of the central bars being described later.

The first-described variant entails a relatively large projecting length of the bars (arms 2) in the retracted position. The second variant overcomes this problem by a special form of the arms 1 and 2.

The slide-way 5 for the box 4 is improved by including a roller track 6, facilitating displacement of the box 4.

The support plate 3 is extended by an end part 10 provided with apertures for entry of the second ends 11 of the second arms 2 in the operative position, the arms 2 fitting into the apertures of the part end 10 of the support plate to form a completely continuous stacking path.

The first end 2*a* of the second arm 2 carries a roller 12 rolling on the slide-way 5. The first arm 1 is likewise provided with a roller 13 at a first elbow portion 1*c*, as viewed from the side, adjacent its second end 1*b*, this roller rolling on the bottom 4*a* of the box 4. The first arm comprises a second elbow portion, as seen from the side, in the shape of a U located at the rear of the device.

The operation of the device is the same as that of the first variant.

In this variant, the front wall 4*c* of the box 4 has to be provided with apertures 9 for passing of the second arms 2. These apertures 9 are preferably identical to the apertures 7 to allow use without regard for the way round of the box 4.

The lateral bars of the bar mechanism are formed in this way. The central bars, preferably three in number, are for their part each formed by first arm whose first end is integral with the first arms 1 of the lateral bars and of which the second end is pivoted to a second arm 2 identical with the arms 2 of the lateral bars.

All the bars thus move with a single movement, the bar mechanism forming a compact assembly whose first arms are integral. The bar mechanism can be seen in FIGS. 5 and 6.

Figure 5:
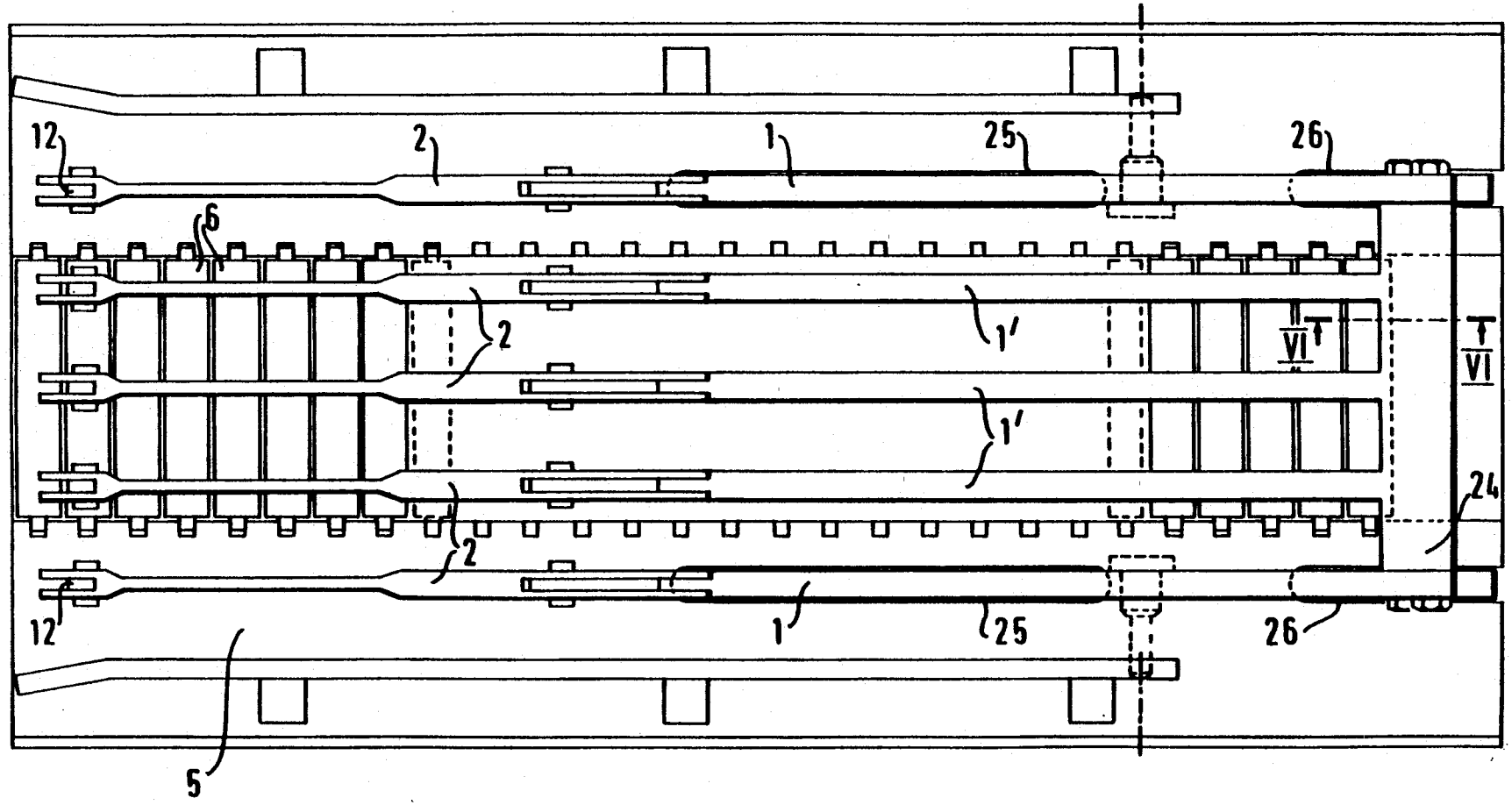
FIG. 5 is top view of the second variant.

FIG. 5 is a view from above showing the bars and the slide-way 5 for the box.

The bars are preferably five in number and the lateral bars are formed from a first arm 1 and a second arm 2 such as are described above.

The three central bars are formed by a first arm 1' and a second arm 2 identical with the foregoing. In order to form a unitary, integral assembly, the arms 1' are formed by a single part with a cross-piece 24, which is fixed to the arms 1 by bolts.

Figure 6:
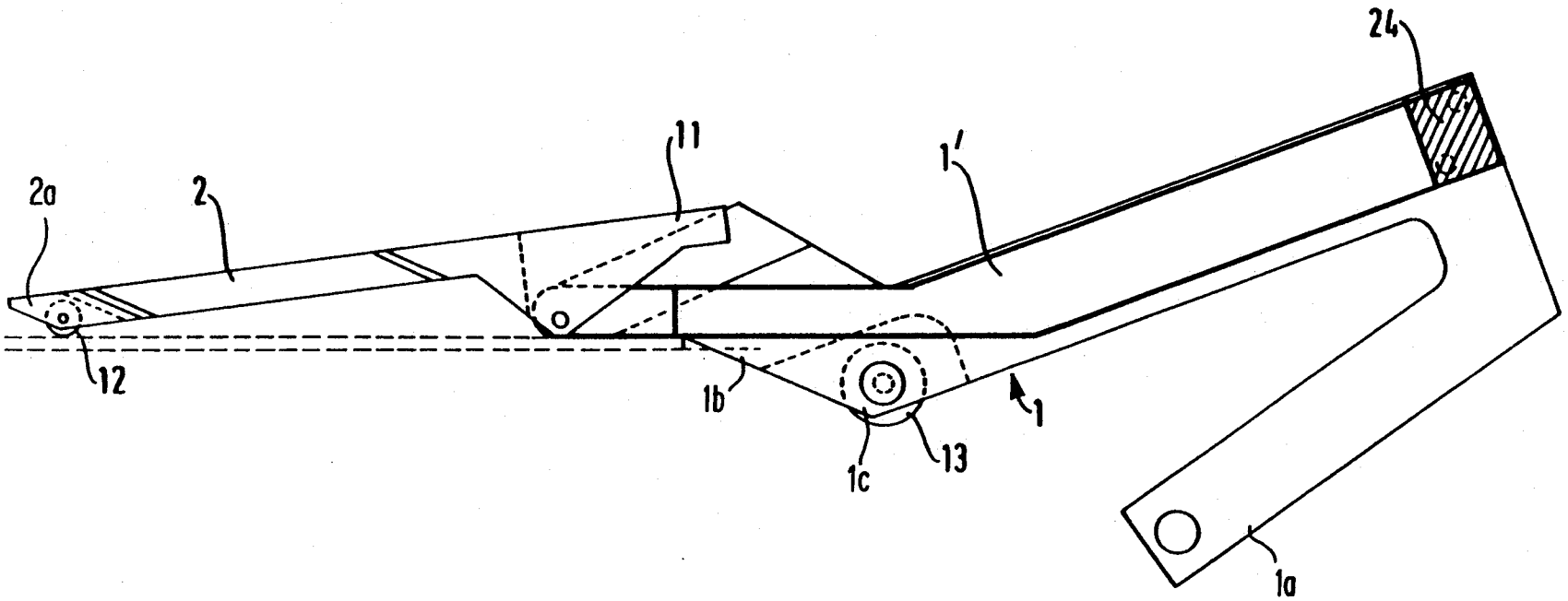
FIG. 6 is side view in section on VI—VI of the bars of the device according to this second variant.

As can likewise be seen from FIG. 6, only the arms 1 with elbows are pivoted directly to the frame of the sorting machine. As a result the arms 1', seen from the side, are of simpler form, without a rear elbow. Their shape is so selected that their associated second arms 2 are aligned with those of the lateral bars.

The slide-way 5 for the box 4 is moreover seen in FIG. 5. It is fitted with rollers 6 in its central part and with apertures 25 and 26 at its edges. These apertures 25 and 26 allow passage of the arms 1 of the lateral bars in their retracted position.

The arms 1' of the central bars are above the sliding plane and the bottom of the box 4, regardless of their position, by virtue of their shape as seen in FIG. 6.

We claim:

1. A device for filling an upwardly open box having a bottom, opposite front and rear walls and at least one aperture formed in at least the rear wall with a stack of face-to-face flat postal items at an output of a postal item processing machine, said machine comprising a frame, at least one inclined support plate for supporting diverted postal items set on edge and forming said stack, a jogging member for lateral abutment with the postal items of said stack and a sliding backing plate supporting a front postal item of the stack subject to a restoring force, a slide-way for supporting said box, said slide-way underlying said inclined support plate and being inclined oppositely to said support plate, said box being placed on said slide-way and being displaceable along said slide-way when filled, said filling device further comprising a bar mechanism having at least one bar retractable through said at least one aperture formed in at least said rear wall of said box and wherein said at least one bar comprise a first arm having first and second ends and first pivoting means connecting said frame of the machine at said first end, and a second arm having first and second ends and second pivoting means connecting said second end of said second arm to said second end of said first arm for positioning said at least one bar in a first position with said second arm beneath said support plate, extending parallel thereto and functioning as an extension of the support plate for partially supporting the stack of postal items and with said first end of the second arm resting on the bottom of the box for facilitating transfer of the stack of postal items from said support plate along said second arm into said box upon completion of a full stack of postal items, and for positioning said at least one bar to a second position where said first arm extends through said at least one aperture and said second arm is parallel to said slide-way and to the bottom of said box and adjacent thereto to permit removal of the box with the stack of items held therein by sliding of said box along said slide-way away from said frame.

2. A device according to claim 1, wherein the slide-way is provided with rollers permitting the bottom of said box to rest on said rollers.

3. A device according to claim 1, wherein said at least one aperture for passage of said at least one bar continues into the bottom of the box such that an end of said aperture located in the bottom of the box forms an abutment for the first arm during displacement of the box.

4. A device according to claim 3, wherein said box further has at least one aperture for said at least one bar in said front wall, for passage of said second arm during movement of the box on said slide-way int he direction of said frame.

5. A device according to claim 1, wherein the support plate has an end part provided with apertures for insertion of the second end of the second arm.

6. A device according to claim 1, wherein the first end of the second arm carries a roller.

7. A device according to claim 1, wherein said at least one bar comprises at least three bars, including two lateral bars and at least one central bar interposed between said two lateral bars.

8. A device according to claim 7, wherein the first arm of each of the lateral bars of the bar mechanism carries a roller at a first elbow portion, as seen from the side, near to said first, end, with the roller rolling on the bottom of the box.

9. A device according to claim 8, wherein the first arm of each of the lateral bars of the bar mechanism comprises a second elbow portion, as seen from the side, in the shape of a U located at the rear of the device.

10. A device according to claim 8, wherein said at least one central bar of the bar mechanism is formed by a said first arm fixed to said fist arms of said lateral bars and by a said second arm.

11. A device for filling an upwardly open box having a bottom, opposite front and rear walls and at least one aperture formed in at least the front wall with a stack of face-to-face, flat postal items at the output of a postal item processing machine, said machine comprising a frame, at least one inclined support plate for supporting diverted postal items set on edge and forming said stack, a jogging member for lateral abutment of the postal items of said stack, a sliding backing plate supporting front postal item of the stack and subject to a restoring force, a slide-way for supporting said box, said slide-way underlying said inclined supported plate, said box being placed on said slide-way and being displaceable when filled along said slide-way, said filling device further comprising at least one bar retractable through said at least one aperture formed in at least the front wall of the box, and wherein said at least one bar is formed of a first arm having a first end and a second end and first pivoting means connecting said first end to said frame of said machine, a second arm having first and second ends and second pivoting means connecting said second end of said second arm to said second end of said first arm for positioning at least one bar in a first position with said second arm positioned beneath said support plate and acting as an extension of the support plate for partially supporting said stack of postal items as the stack increases in size and for positioned said at least one bar to a second position, wherein said second arm extends through said at least one aperture and is parallel to said slide-way and to the bottom of said box and adjacent thereto, thereby permitting removal of the box with a stack of items held therein to permit, after displacing said sliding backing plate from a position supporting said front postal item of said stack removal of said box by sliding of said box along said slide-way in a direction away from said frame.

* * * * *